US010981041B2

(12) United States Patent
McGetrick

(10) Patent No.: US 10,981,041 B2
(45) Date of Patent: Apr. 20, 2021

(54) GAME SYSTEM WITH TOSSABLE OBJECT AND METHOD OF ASSEMBLY

(71) Applicant: Kyle P. McGetrick, Santa Barbara, CA (US)

(72) Inventor: Kyle P. McGetrick, Santa Barbara, CA (US)

( * ) Notice: Subject to any disclaimer, the term of this patent is extended or adjusted under 35 U.S.C. 154(b) by 0 days.

(21) Appl. No.: 16/791,237

(22) Filed: Feb. 14, 2020

(65) Prior Publication Data

US 2020/0261783 A1 Aug. 20, 2020

Related U.S. Application Data

(60) Provisional application No. 62/805,550, filed on Feb. 14, 2019.

(51) Int. Cl.
*A63B 67/06* (2006.01)

(52) U.S. Cl.
CPC ..... *A63B 67/06* (2013.01); *A63B 2067/063* (2013.01); *A63B 2210/50* (2013.01)

(58) Field of Classification Search
CPC ..... A63B 67/06; A63B 2067/063; A63B 2210/50
See application file for complete search history.

(56) References Cited

U.S. PATENT DOCUMENTS 1,052,907 A 2/1913 Fergusson
1,121,353 A 12/1914 Grikscheit
1,398,511 A 11/1921 Hanrath
2,095,390 A 10/1937 Lange et al.
2,147,176 A 2/1939 Ronzone
2,942,886 A 6/1960 Ackerman
2,950,917 A 8/1960 Lyon
2,950,918 A 8/1960 Lyon
2,991,034 A 7/1961 Lyon
3,009,702 A 11/1961 Lyon
3,023,001 A 2/1962 Gourdouze
3,051,491 A 8/1962 Cabot
3,288,466 A 11/1966 Cumings
3,520,535 A 7/1970 Dubbs et al.
3,656,747 A 4/1972 Revell, Jr.
4,120,498 A 10/1978 Mutschler et al.
4,273,340 A * 6/1981 Hackett ..... A63B 67/06 273/336
4,564,200 A 1/1986 Loring et al.
4,635,942 A 1/1987 Flaherty, Jr.
(Continued)

*Primary Examiner* — Raleigh W Chiu
(74) *Attorney, Agent, or Firm* — Law Office of Mark Brown, LLC; Christopher M. DeBacker

(57) ABSTRACT

A two-player versus game system which can be completely disassembled and stored for easy storage and transport, and which can quickly be assembled into a functioning game system. The system includes a central tower from which a ring or a ball on a string hangs over the playing area. A scoring element is extended vertically on either side of the player area, one for each player. The base of the container can include score-keeping devices attached thereto, such as sliding beads on a rod for quickly tabulating when a player scores a hook on a ring or a ball in a basket. The scoring elements and the central tower both can all be removed from their respective receivers within the base of the container and laid flat within the container, and the lid can close the container.

13 Claims, 15 Drawing Sheets

(56) References Cited

U.S. PATENT DOCUMENTS

| | | | | |
|---|---|---|---|---|
| 5,171,019 | A | 12/1992 | Arnette | |
| 5,221,089 | A * | 6/1993 | Barrett | A63B 69/0059 473/215 |
| 5,337,996 | A | 8/1994 | Kalish | |
| 7,896,349 | B2 | 3/2011 | Pershin et al. | |
| 8,011,664 | B2 | 9/2011 | Hilbert, Jr. et al. | |
| 8,720,895 | B2 | 5/2014 | Matthis | |
| 8,720,896 | B2 | 5/2014 | Matthis | |
| 9,267,769 | B1 | 2/2016 | Gempler | |
| 2008/0116644 | A1* | 5/2008 | Knoernschild | A63B 67/06 273/336 |
| 2009/0115136 | A1* | 5/2009 | Voden | A63B 67/06 273/336 |
| 2009/0206550 | A1 | 8/2009 | Pershin et al. | |
| 2010/0187760 | A1* | 7/2010 | Hilbert, Jr. | A63B 67/10 273/332 |
| 2012/0312937 | A1* | 12/2012 | Weber | A63B 69/0079 248/125.2 |
| 2014/0049007 | A1* | 2/2014 | McGetrick | A63F 9/0208 273/332 |
| 2015/0115530 | A1* | 4/2015 | Vanston | A63F 9/0208 273/332 |
| 2015/0137452 | A1* | 5/2015 | Dahl | A63F 7/0017 273/342 |
| 2016/0339315 | A1 | 11/2016 | Mcgetrick | |
| 2016/0339333 | A1* | 11/2016 | McGetrick | A63B 67/06 |
| 2018/0272212 | A1* | 9/2018 | Underwood | A63B 71/023 |
| 2019/0262682 | A1* | 8/2019 | McGetrick | A63B 63/08 |
| 2020/0261783 | A1* | 8/2020 | McGetrick | A63B 67/06 |

* cited by examiner

GAME SYSTEM WITH TOSSABLE OBJECT AND METHOD OF ASSEMBLY

CROSS-REFERENCE TO RELATED APPLICATION

This application claims priority in U.S. Provisional Patent Application No. 62/805,550 Filed Feb. 14, 2019, which is incorporated herein by reference.

BACKGROUND OF THE INVENTION

1. Field of the Invention

The present invention relates generally to a game system and method for use thereof, and more specifically to a competitive two-player versus game system with a hook-and-ring toss or basket-and-ball toss element which is completely able to be disassembled for easy storage and transport.

2. Description of the Related Art

Popular gaming systems include ring toss games involving a ring, a hook, and a board have existed for a long time. Similar games which also involve a rod extending out above the board with a string affixed to the rod and the ring have also been around for quite some time. Variants of this game come in a number of names, such as "Bimini Ring," "Bimini Toss," "Tiki Toss," "Wallhooky," and, simply, "Ring Toss."

The typical set-up for such a game requires the user to place a hook somewhere, either temporarily or permanently. A ring is then affixed to a string by tying the string directly to the edge of the ring. The other end of the string is affixed to a rod or other object, allowing the user to swing the ring from a starting position and attempt to hook the ring onto the hook.

If multiple users want to play at the same time, they must take turns or each user would have to have their own entire game to play. This limits the ability for multiple people to play the existing ring toss games.

What is desired is a new gaming system with a head-to-head competitive aspect which can quickly be assembled or disassembled, packed up, and taken with the user. Heretofore there has not been available a game system with the advantages and features of the present invention. Furthermore, it is desired that two players can share one ring or ball (on string) but have two separate targets. Players sit across from each other and can aim for the target at their opponents end or swing the ring/ball in a way that it comes back to land on the target at their own end of the board. Having only one ring/ball (on string) but two targets makes for a streamlined way for 2 people to play this type of game at once. Less materials and space are required using this system for two players.

BRIEF SUMMARY OF THE INVENTION

The present invention generally provides a two-player versus game system which can be completely disassembled and stored for easy storage and transport, and which can quickly be assembled into a functioning game system.

The system includes a central tower which includes vertical, horizontal, and/or angled elements for hanging a ring or a ball on a string over the playing area. A scoring element is extended vertically on either side of the player area, one for each player. For a hanging ring, each scoring element includes a hook. For a hanging ball, each scoring element includes a basket which may or may not include a basketball net.

The base of the container can include score-keeping devices attached thereto, such as sliding beads on a rod for quickly tabulating when a player scores a hook on a ring or a ball in a basket. The scoring elements and the central tower both can all be removed from their respective receivers within the base of the container and laid flat within the container, and the lid can close the container.

The advantage presented by the present invention provides a competitive and compact gaming system which prevents the need for multiple hook-and-ring or ball-and-hoop games to be set up for multiple players to play. The two targets which both can be reached by a single tossable object provides a unique competitive game in a single system.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Game System 2

Figure 1:
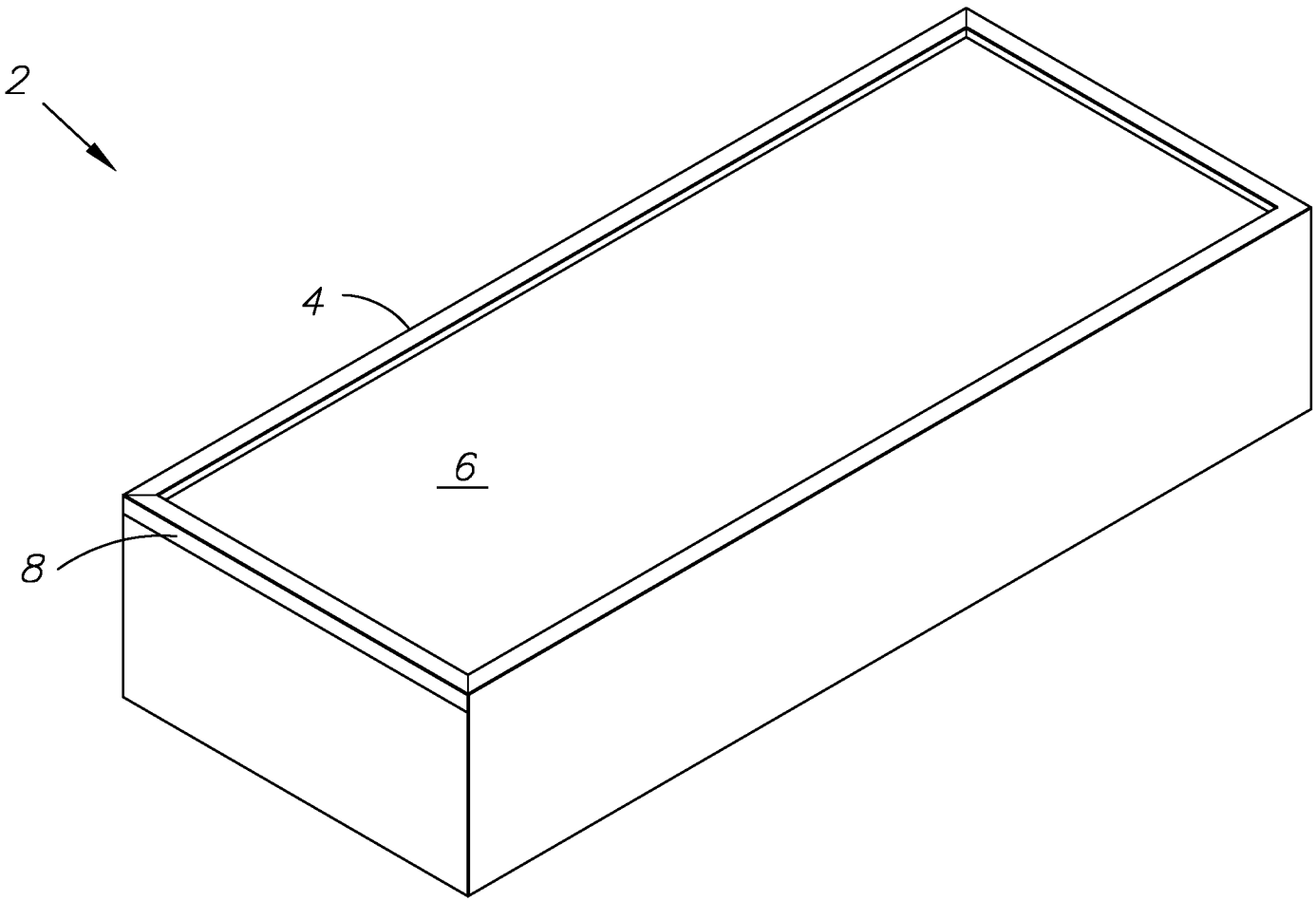
FIG. 1 is a three-dimensional isometric view of a preferred embodiment of the present invention shown in a stored orientation with a closed base container.
Figure 2:
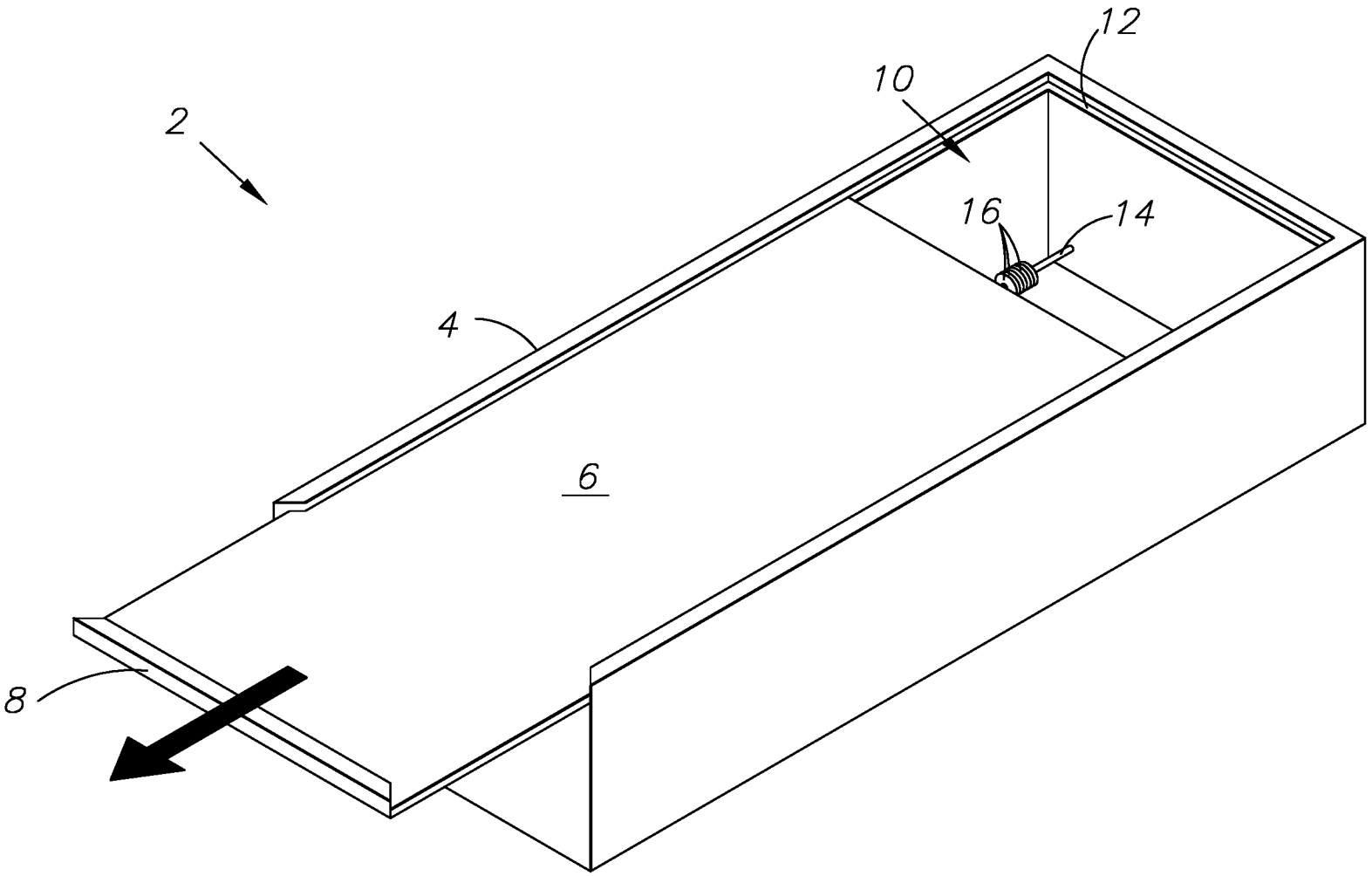
FIG. 2 is a three-dimensional isometric view thereof, showing a lid element being removed.

As shown in the figures, the present invention is a two-player versus gaming system 2 which has a base container 4 with a lid 6 which forms the playing area when assembled. FIG. 1 shows the base container 4 in a closed orientation with the lid 6 inserted into a slot 12 of the base container 4 as seen in FIG. 2. FIG. 2 shows the lid 6 being removed from the slot 12 of the base container 4, with the grip 8 being used to pull the lid 6 from the slot 12.

Figure 3:
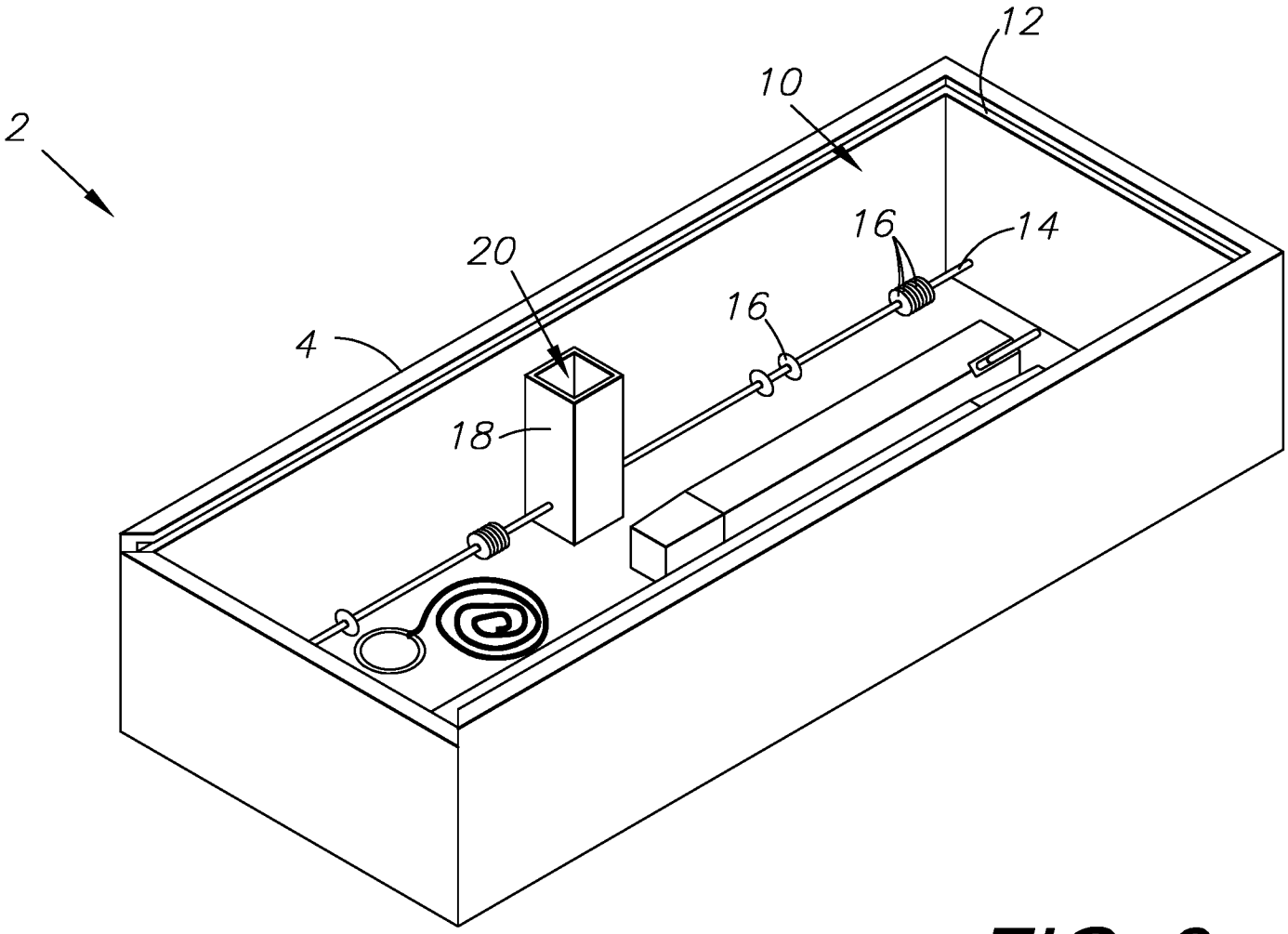
FIG. 3 is a three-dimensional isometric view thereof, showing the lid element completely removed.
Figure 4:
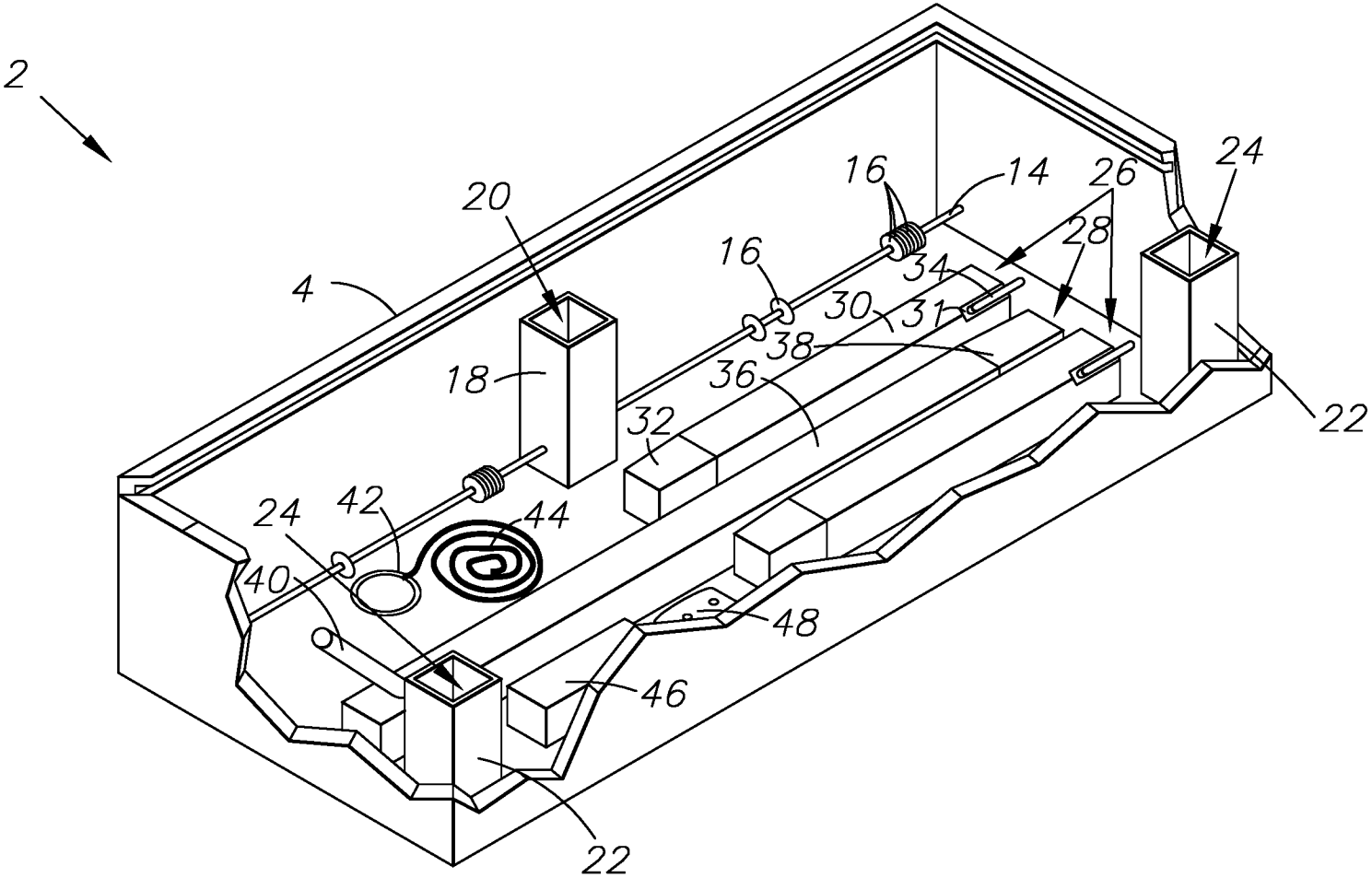
FIG. 4 a three-dimensional isometric view thereof with a cut-away portion showing the contents of the base container element.

FIG. 3 shows the opened base container 4, and FIG. 4 contains a cut-away portion showing the contents of the base container 4 in more detail. A tower slot 18 with tower receiver 20 and a pair of scoring post slots 22 with scoring post receiver 24 are affixed to the internal space 10 of the base container 4. A rod 14 with scoring indicators 16 slidably placed onto the rod is connected to the interior of the base container 4. These scoring indicators 16 can be slid along the rod 14 as players score while playing the game.

Figure 5:
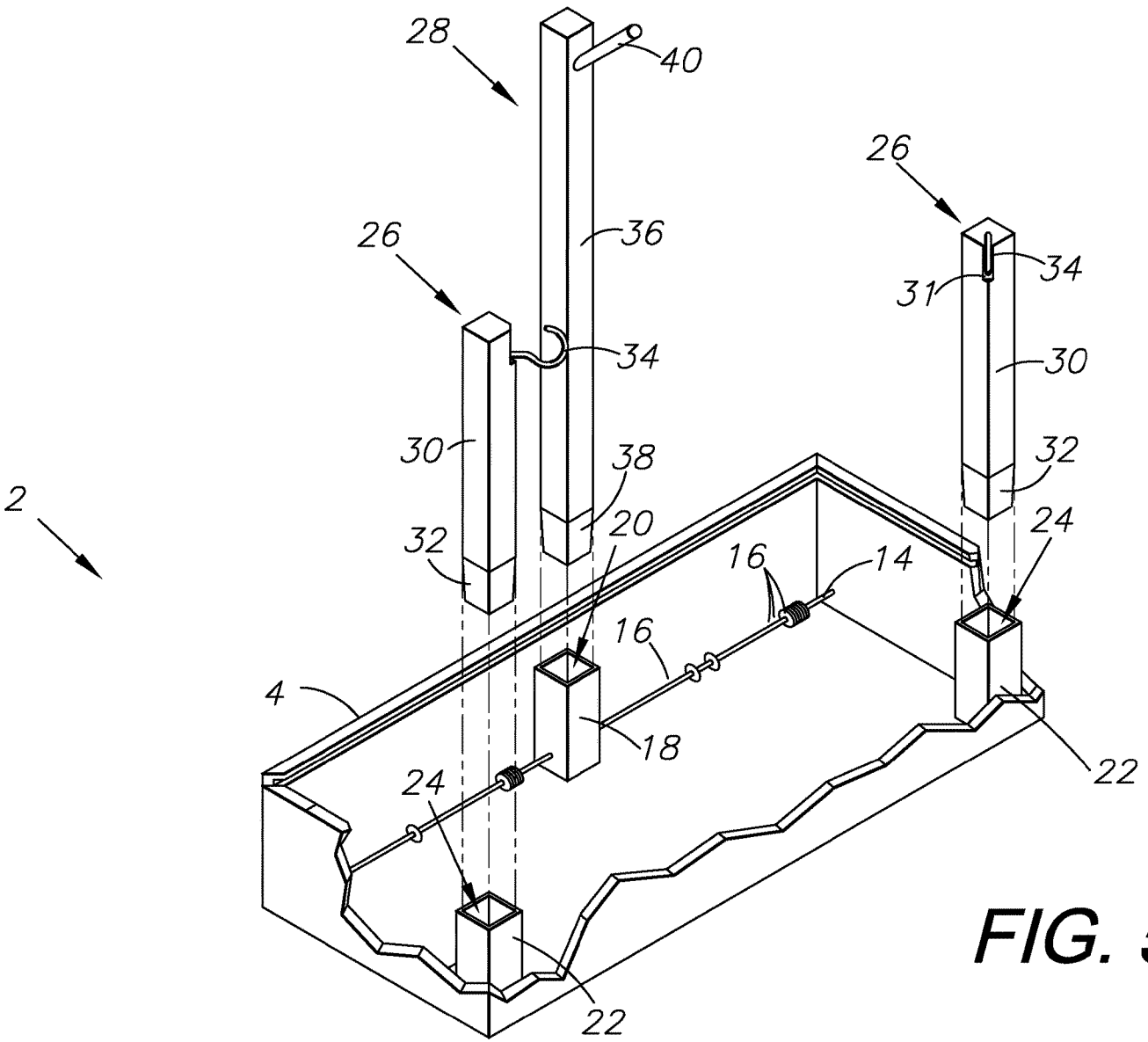
FIG. 5 is a partially-exploded three-dimensional isometric view thereof, showing steps of assembly.
Figure 6:
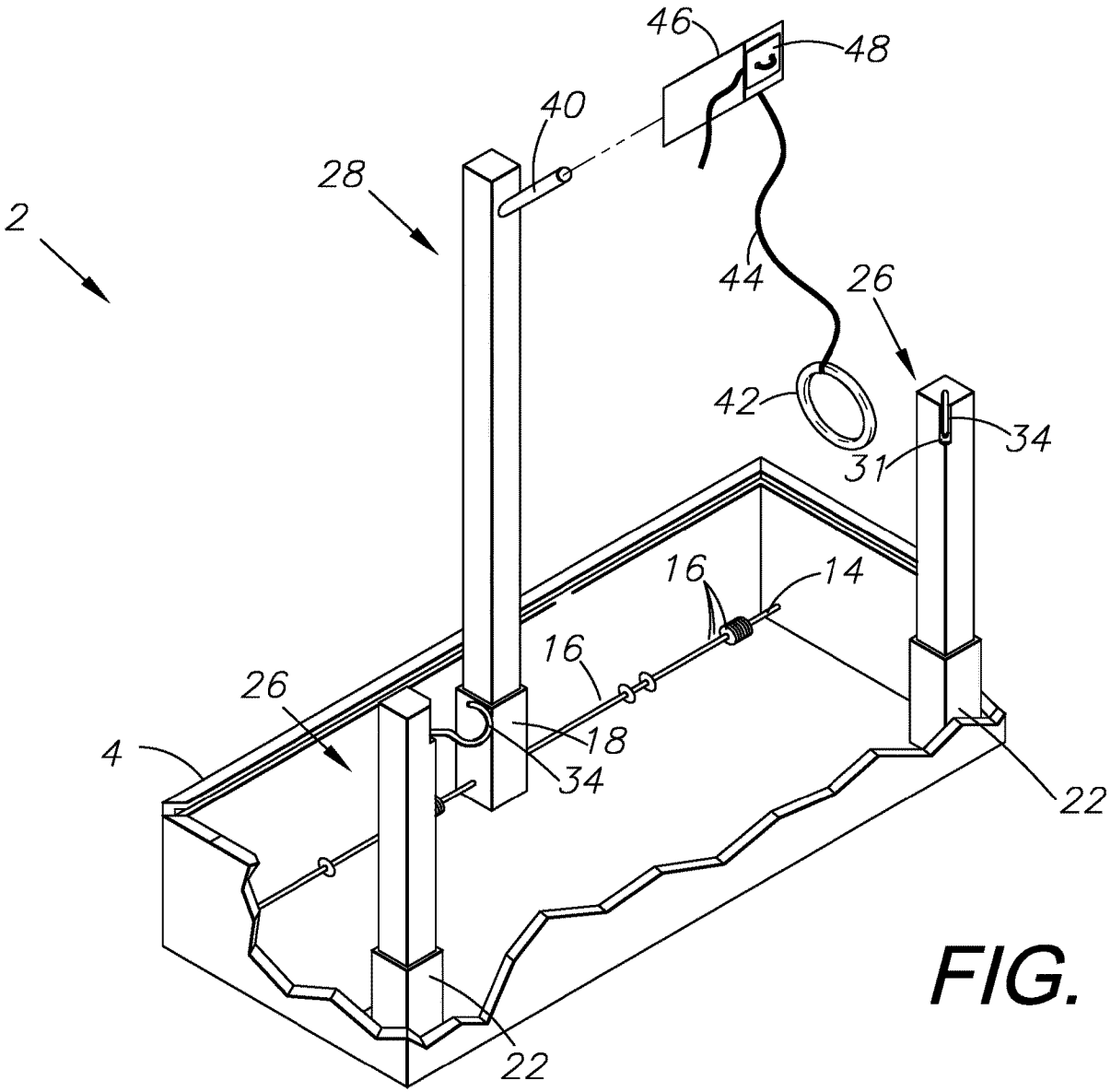
FIG. 6 is another partially-exploded three-dimensional isometric view thereof, showing additional steps of assembly

A tower 28 with a tower body 36, tower insert 38, and a stem 40 is designed to slot into the tower slot 18. As shown in FIGS. 5 and 6, the tower insert 38 is fitted into the tower receiver 20. The stem 40 points out over the interior space 10 of the base container 4. Two scoring posts 26 are similarly inserted into their respective scoring post slots 22. The scoring posts 26 each have a scoring post body 30, scoring post insert 32, and a goal 34, such as a hook as shown. The goal may also be a basket, hole, or other suitable target. As shown, the goal body 30 may have a corner slot 31 where the target 34 is affixed to properly angle the targets towards one another in relation with the stem 40.

Figure 7A:
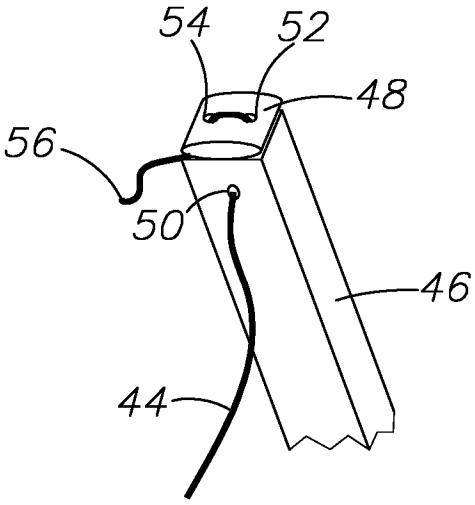
FIG. 7A is a three-dimensional view thereof showing the arm element and string lock element assembled.
Figure 7:
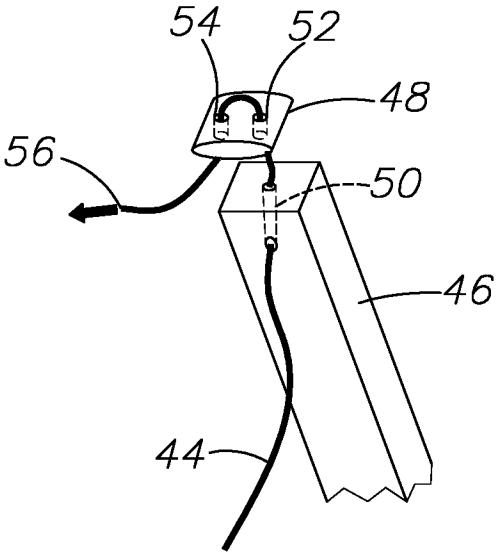
FIG. 7 is a three-dimensional view of an arm element and a string lock element showing assembly of those elements.
Figure 8:
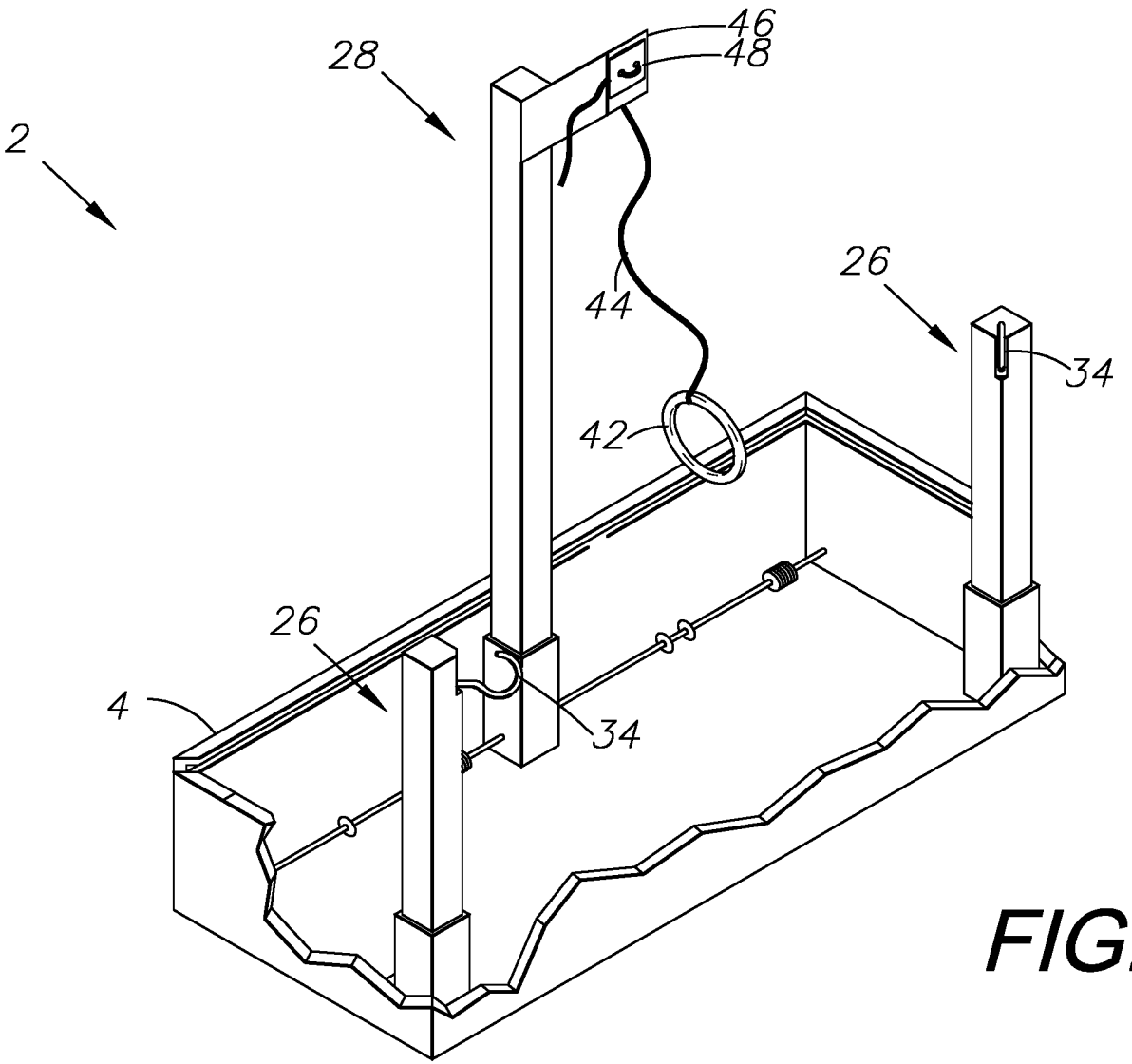
FIG. 8 is a three-dimensional isometric view of the preferred embodiment of the present invention shown in a fully assembled orientation with a partial cut-away portion.
Figure 9:
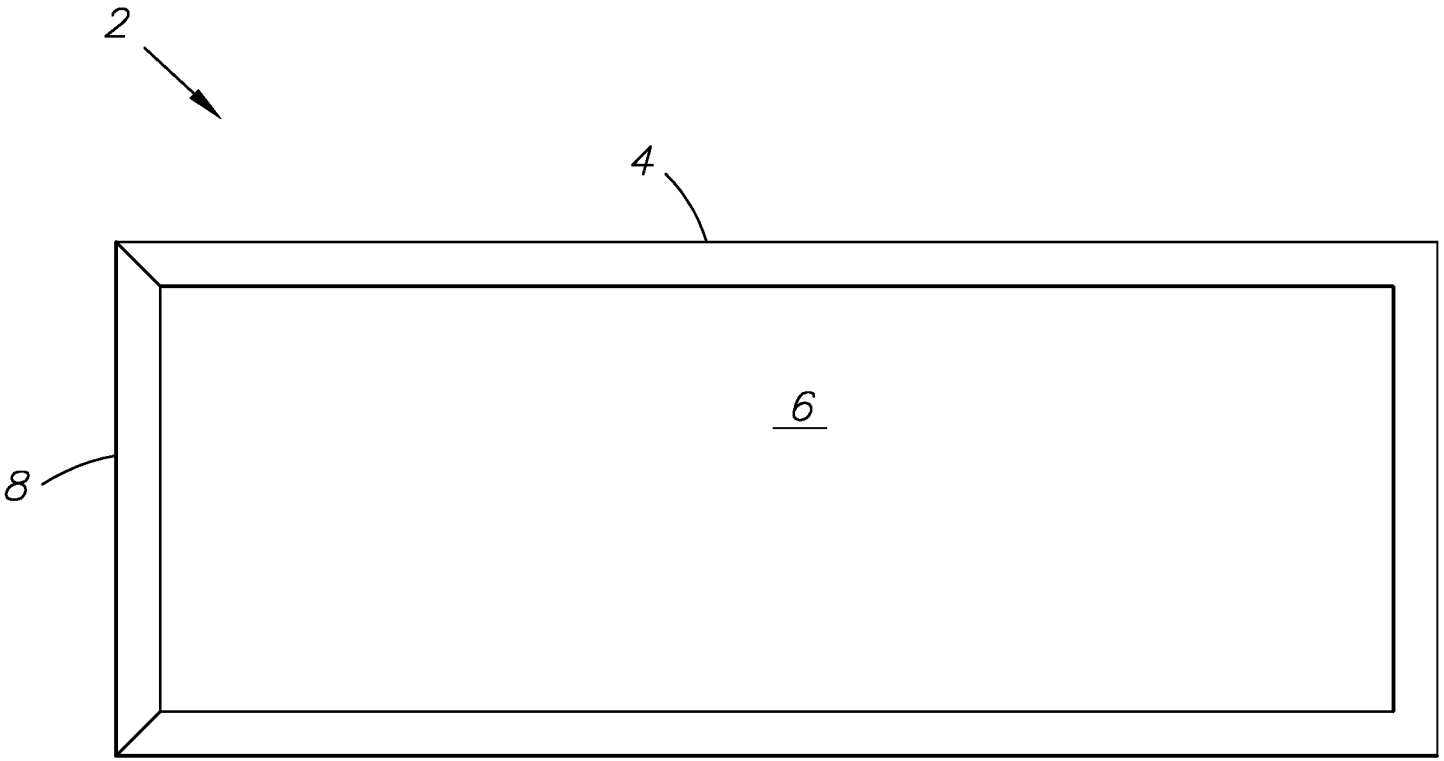
FIG. 9 is a top plan view of FIG. 1.
Figure 10:
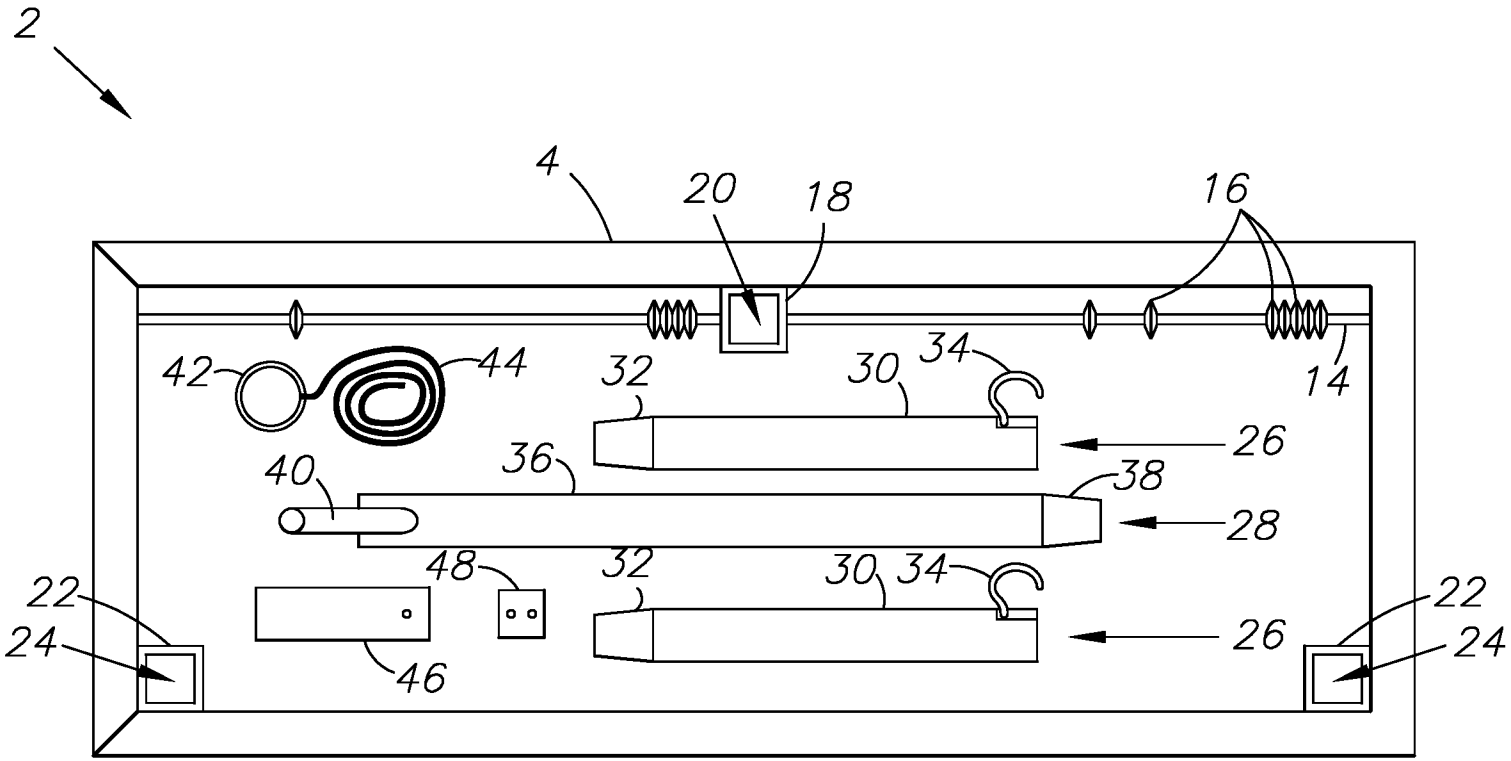
FIG. 10 is a top plan view of FIG. 3.
Figure 11:
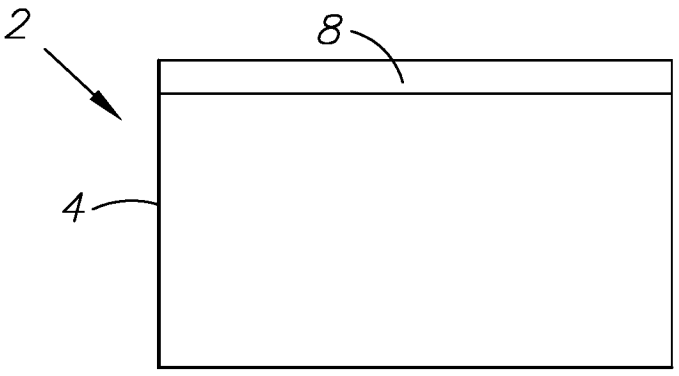
FIG. 11 is a left side elevational view of FIG. 1.
Figure 12:
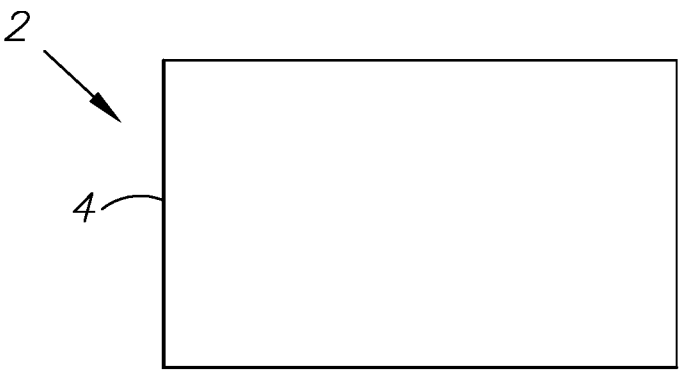
FIG. 12 is a right side elevational view thereof.
Figure 13:
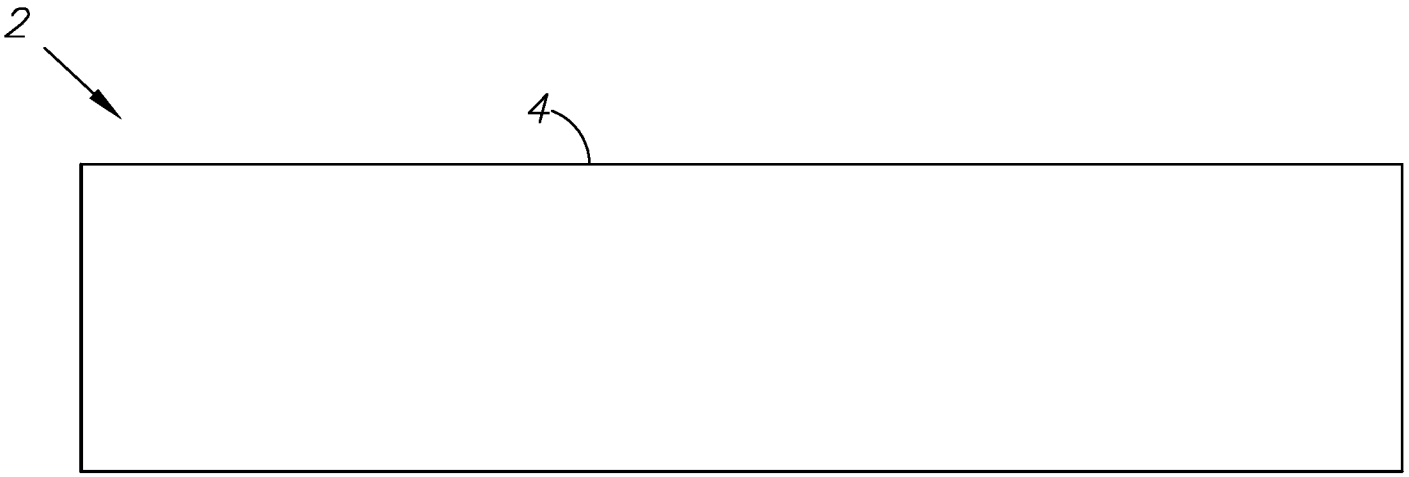
FIG. 13 is a front side elevational view thereof, the rear side elevational view being a mirror image thereof.
Figure 14:
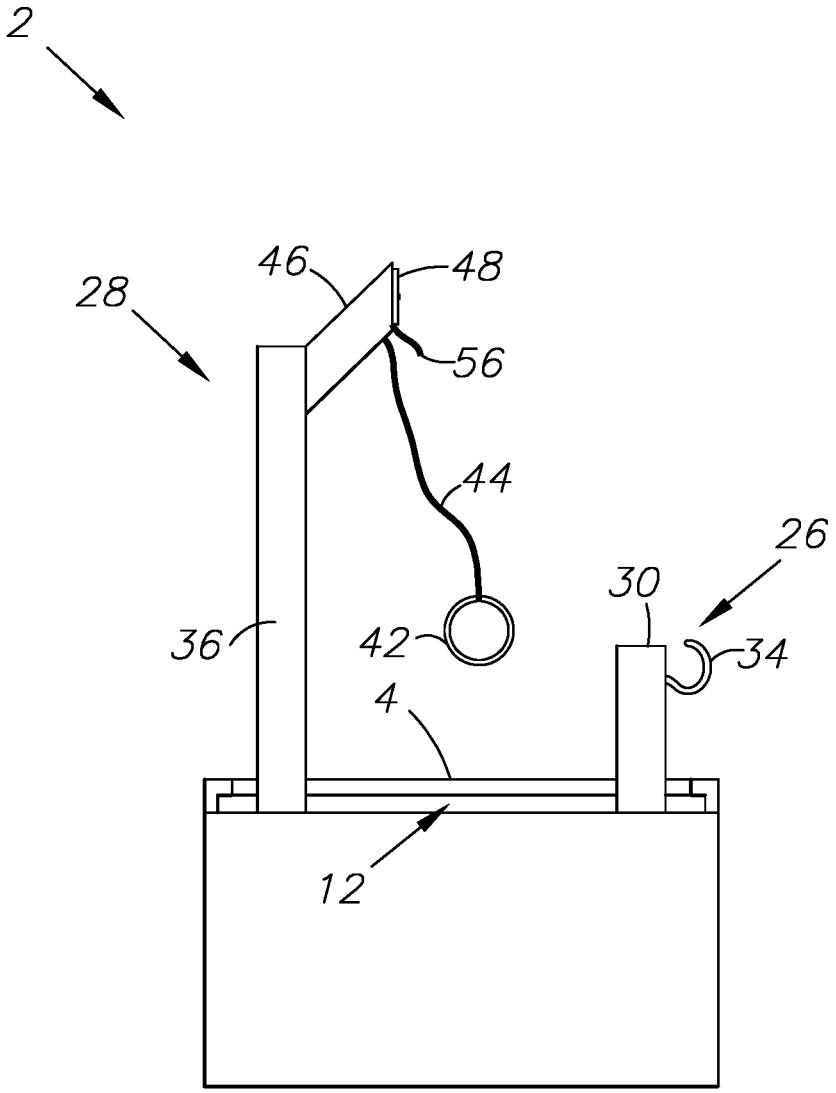
FIG. 14 is a left side elevational view of FIG. 8.
Figure 15:
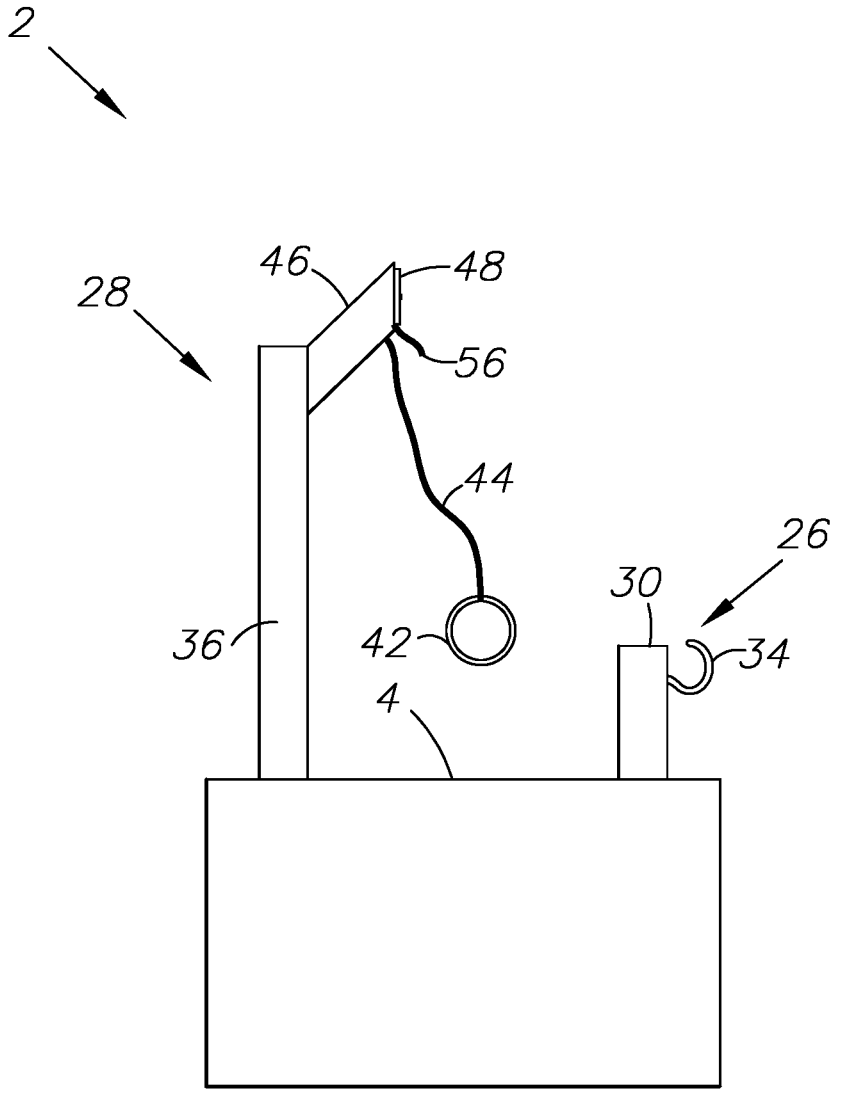
FIG. 15 is a right side elevational view thereof.
Figure 16:
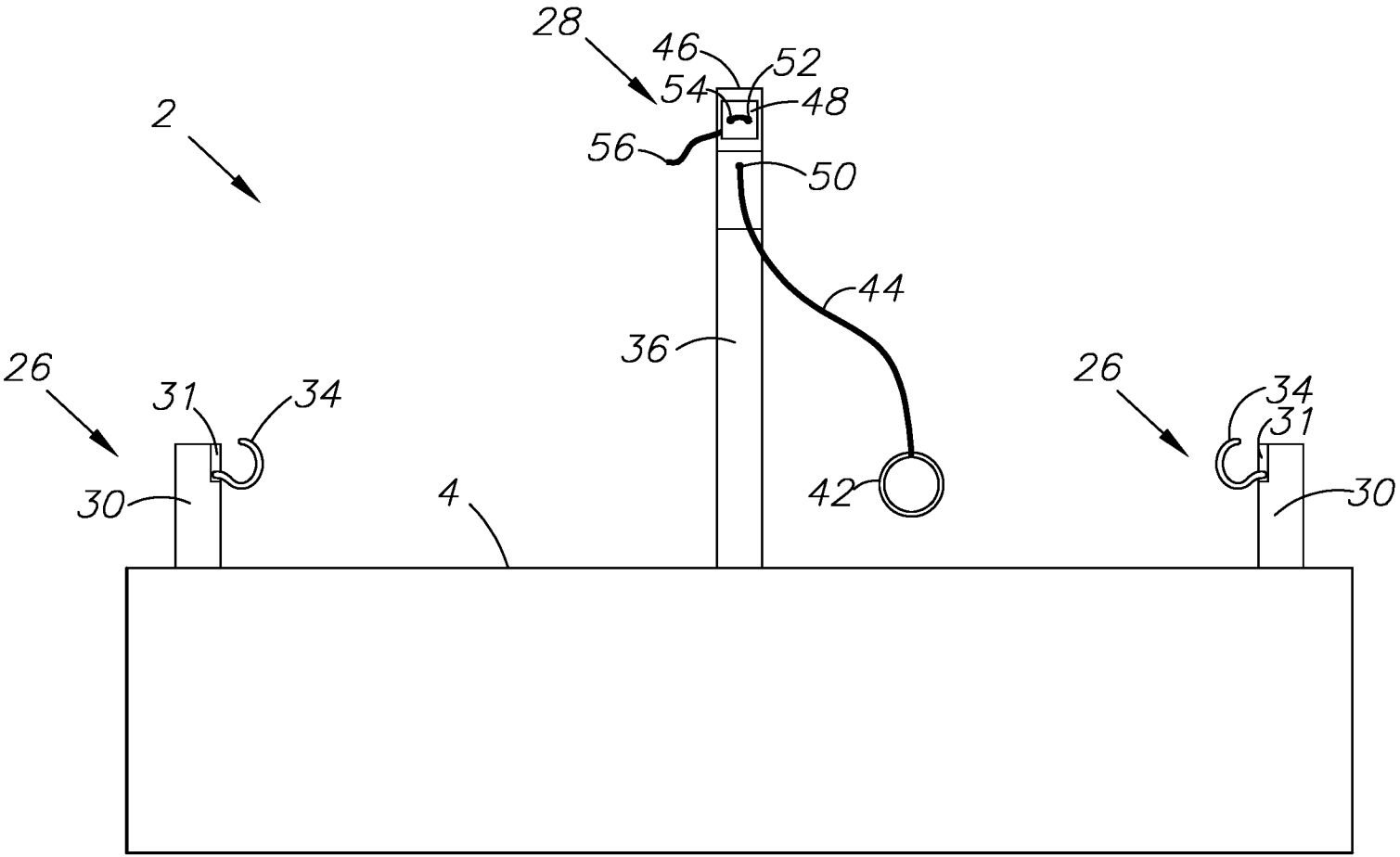
FIG. 16 is a front side elevational view thereof.
Figure 17:
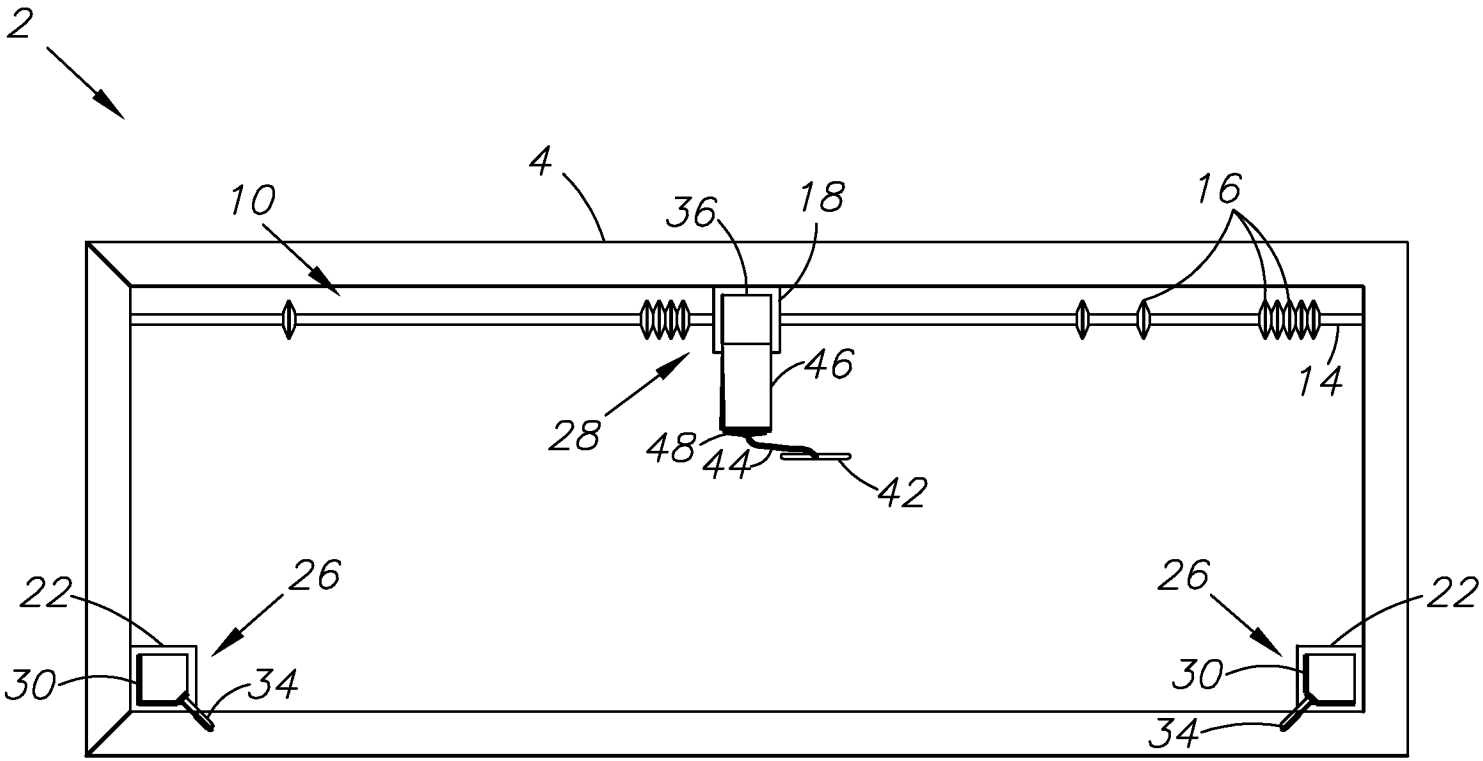
FIG. 17 is a top plan view thereof.

FIG. 6 shows an arm 46 slotted onto the stem 40 of the tower 28. As shown in FIGS. 7 and 7A, the arm 46 has a hole 50 for receiving a cord 44 tied to a tossable object 42, such as a hook as shown. The tossable object may also be a ball or other suitable shape for being received by the targets 34. The cord 44 passes through the hole 50 of the arm 46 and through a first 52 and second 54 hole of a cord lock 48 which secures the cord 44 to the arm 46. The free end 56 of the cord can be adjusted such that the tossable object 42 can rest against each goal 34 while remaining just slack enough for good game play. The slack in the cord 44 can be adjusted using the cord lock 48 as needed during game play. FIG. 8 shows the entire game system 2 as assembled for play.

FIGS. 9-17 show additional views of the preferred embodiment of the present invention.

During gameplay, the tossable object 42 is hung from a string from the end of the arm 46 connected to the tower 28. In an embodiment where the tossable object is a ring, each of the scoring posts include a hook for receiving the ring. In an embodiment where the tossable object is a ball, each of the scoring posts include a basket or hoop for receiving the ball. In the preferred embodiment as shown, there is only one tossable object 42 connected to the tower 28 arm 46 by the cord 44. This one object is tossed by both players towards one of the two scoring posts 26 and the target 34 (e.g. hook or basket/hoop) located on that respective post. The tossable object can reach either of the goals 34 without moving the arm 46 or otherwise adjusting the arm, cord, or tossable object.

Scoring occurs when one player tosses the object and hooks it or scores the ball within the hoop of the opposing scoring post. The scoring indicators 16 provide detailed score-keeping formed from sliding beads on a rod 14 which can be used to keep score of the game. Any suitable scoring system could be used as well, including a digital score-keeping device. The players alternate turns tossing the tossable object. The winner is the first player to reach a predetermined number of scores on the opposing side's scoring post.

It is to be understood that while certain embodiments and/or aspects of the invention have been shown and described, the invention is not limited thereto and encompasses various other embodiments and aspects.

The invention claimed is:

1. A game system comprising:

a container base comprising a box having a top opening and a lid removably placed over said top opening;

said container base defining an interior space, said interior space configured for containing a tower, a pair of scoring posts, an arm, and a cord affixed to a tossable object;

a rod and a plurality of scoring indicators slideably engaged with said rod affixed within said interior space of said container base;

a tower slot comprising a tower receiver affixed within said interior space of said container base;

a pair of scoring post slots each comprising a respective scoring post receiver affixed within said interior space of said container base;

said tower configured to be inserted into said tower receiver of said tower slot, said arm configured to be connected to said tower, and said cord configured to be connected to said arm such that said cord and said tossable object hang down from said arm above said container base;

each one of said pair of scoring posts configured to be inserted into one scoring post receiver of a respective one of said pair of scoring post slots;

each one of said pair of scoring posts further comprising a respective goal; and wherein said tossable object is configured to be tossed toward a respective goal during play.

2. The game system of claim 1, further comprising:

a cord lock comprising a first hole and a second hole;

said cord configured to pass through said arm hole, said first hole, and then said second hole of said cord lock, such that said cord lock adjusts said cord's length; and said cord lock configured to be placed against an end of said arm.

3. The game system of claim 1, further comprising:

said tower comprising a tower body, a tower insert, and a stem;

said tower insert configured to connect said tower into said tower receiver of said tower slot; and said stem configured to receive said arm.

4. The game system of claim 1, further comprising:

each one of said pair of scoring posts comprising a scoring post body and a scoring post insert; and each scoring post insert configured to connect said respective one of said pair of scoring posts to a respective scoring post receiver of said pair of scoring posts slots.

5. The game system of claim 4, further comprising:

each one of said pair of scoring posts comprising a corner slot; and each goal affixed to a respective corner slot of said pair of scoring posts.

6. The game system of claim 1, wherein said tossable object comprises a ring and said targets each comprise a hook.

7. The game system of claim 1, wherein said tossable object comprises a ball and said targets each comprise a container.

8. A method of interacting with a game system, the method comprising the steps:

removing a lid from a container base, thereby opening a top opening of said container base and exposing an interior space within said container base;

removing a tower comprising a tower body from said interior space and inserting said tower into a tower slot comprising a tower receiver, said tower slot affixed to said container base within said interior space;

removing a pair of scoring posts, each comprising a respective scoring post body, from said interior space and inserting each respective one of said pair of scoring posts into a respective one of a pair of scoring post slots, each of said pair of scoring post slots comprising a respective scoring post receiver, and each of said pair of scoring posts slots affixed to said container base within said interior space;

removing an arm from said interior space and connecting said arm to said tower such that said arm extends outwards from said tower towards said pair of scoring posts;

removing a cord from said interior space, said cord affixed to a tossable object;

connecting said cord to said arm;

tossing said tossable object toward a target affixed to one of said pair of scoring posts; and sliding a scoring indicator along a rod affixed to said container base within said interior space.

9. The method of claim 8, further comprising the steps:

connecting said cord to a cord lock through a first and second hole of said cord lock;

placing said cord lock against an end of said arm; and adjusting a length of said cord with said cord lock.

10. The method of claim 8, further comprising the step of securing said arm against said tower by inserting said arm over a stem affixed to said tower.

11. The method of claim 8, further comprising the steps:

connecting said tower with said tower slot via a tower insert affixed to a bottom edge of said tower body; and connecting each respective one of said pair of scoring posts to their respective one of said pair of scoring post slots via a respective scoring post insert affixed to a bottom edge of each respective one of said scoring post bodies.

12. The method of claim 8, wherein said tossable object comprises a ring and said targets each comprise a hook.

13. The method of claim 8, wherein said tossable object comprises a ball and said targets each comprise a container.

* * * * *